US005165435A

United States Patent [19]

Thies et al.

[11] Patent Number: 5,165,435

[45] Date of Patent: Nov. 24, 1992

[54] WASH ARM ASSEMBLY FOR A DOMESTIC DISHWASHER

[75] Inventors: Edward L. Thies; Theodore F. Meyers, both of Monroe Township, Miami County, Ohio

[73] Assignee: Whirlpool Corporation, Benton Harbor, Mich.

[21] Appl. No.: 747,211

[22] Filed: Aug. 19, 1991

[51] Int. Cl.[5] ..... A47L 15/23; A47L 15/42

[52] U.S. Cl. ..... 134/181; 210/411

[58] Field of Search ..... 134/104.1, 104.4, 111, 134/176, 179, 180, 181; 210/411

[56] References Cited

U.S. PATENT DOCUMENTS

| | | | |
|---|---|---|---|
| 3,575,185 | 4/1971 | Barbulesco | 134/104.4 X |
| 3,809,106 | 5/1974 | Crabtree | 134/176 |
| 4,038,103 | 7/1977 | Grunewald | 134/104.1 X |
| 4,392,891 | 7/1983 | Meyers | 134/10 |
| 4,673,441 | 6/1987 | Mayers | 134/18 |
| 4,972,861 | 11/1990 | Milocco et al. | 134/104.1 |

FOREIGN PATENT DOCUMENTS

| | | | |
|---|---|---|---|
| 621747 | 5/1927 | France | 134/179 |

*Primary Examiner*—Philip R. Coe

*Attorney, Agent, or Firm*—Thomas J. Roth; Stephen D. Krefman; Thomas E. Turcotte

[57] ABSTRACT

A wash arm assembly for a dishwasher includes a plurality of wash arms extending radially from a hub. The hub includes an interior fluid passageway, and is rotatably mounted on a dishwasher soil separator. Each wash arm includes a plurality of apertures for permitting wash liquid to flow therethrough, at least one of which on each spray arm is directed downwardly to provide a downwardly directed cleansing spray of wash liquid. Mounted to the wash arms is a disc-shaped filter guard which includes a plurality of elongate apertures, each of which apertures corresponds to a downwardly directed wash arm aperture. Disposed within each elongate aperture is an elongate tab having a planar surface, which is disposed adjacent to and partially overlying the corresponding wash arm aperture. The soil separator includes an upward-facing cover, which cover includes an annular fine filter coaxially located with the wash arm assembly axis. In operation, wash liquid is pumped into the wash arm assembly, causing the wash arm assembly to rotate, each wash arm providing a downwardly directed fan-shaped spray. As the wash arm assembly rotates, each fan-shaped spray describes an arcuated path corresponding to the annular fine filter, thereby providing an effective backflushing action.

6 Claims, 3 Drawing Sheets

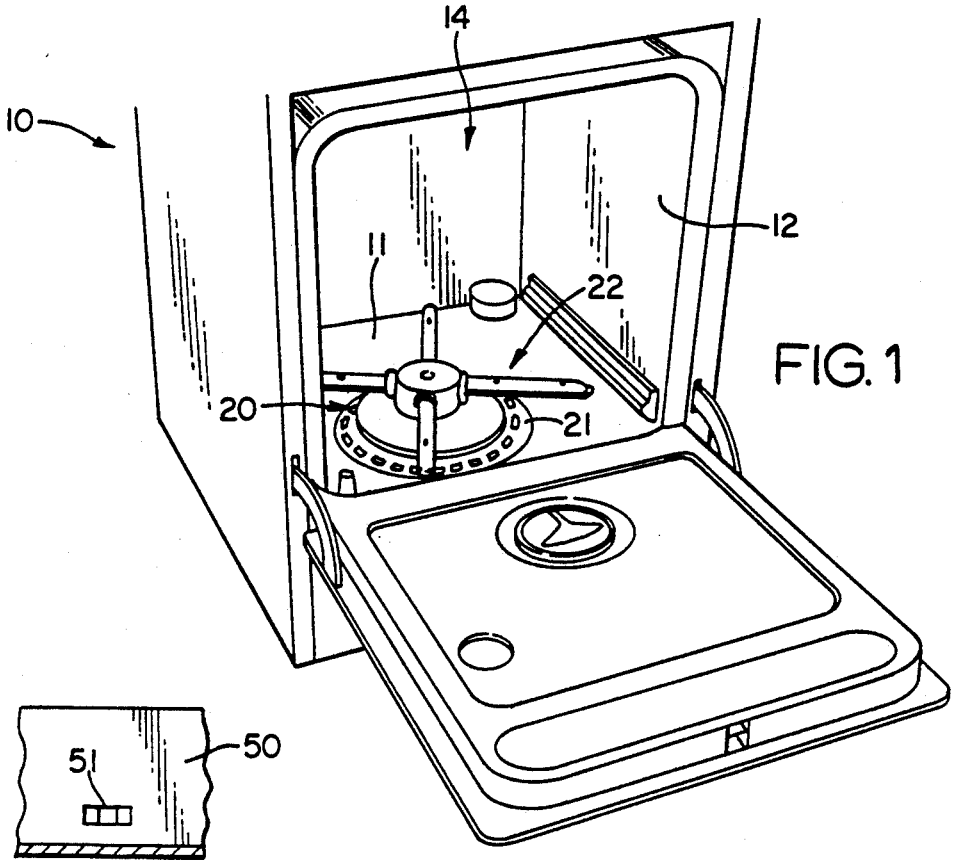
FIG. 1
FIG. 4
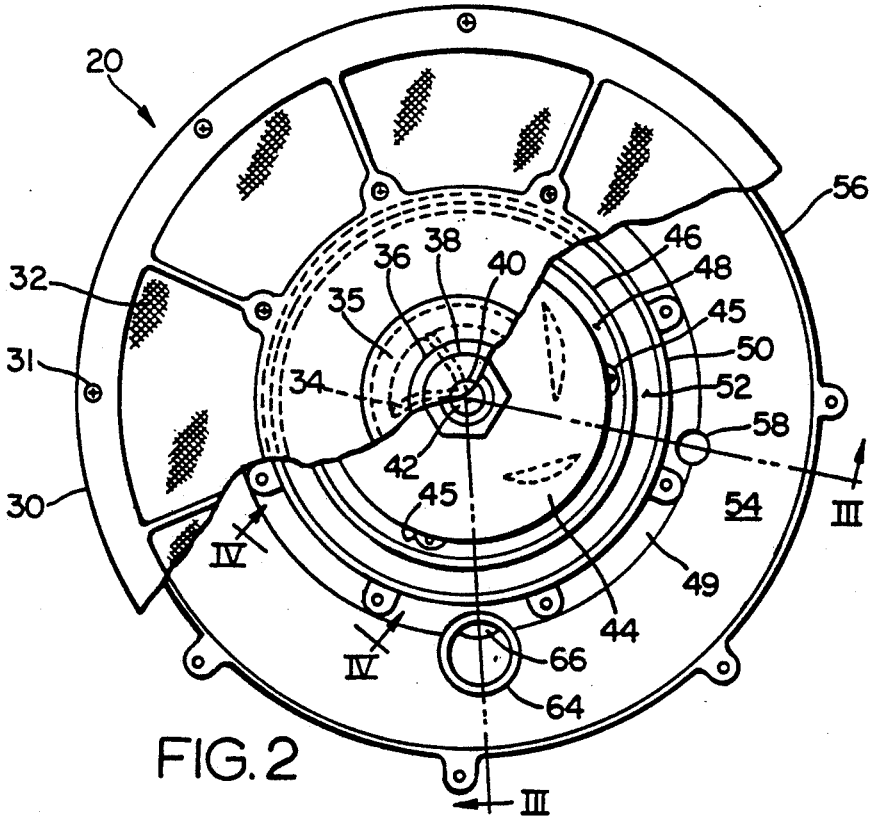
FIG. 2

WASH ARM ASSEMBLY FOR A DOMESTIC DISHWASHER

BACKGROUND OF THE INVENTION

The present invention is directed to a wash arm for a dishwasher and particularly to a wash arm assembly for use in conjunction with a centrifugal soil separator which incorporates a fine filter for removing soil particles of varying specific gravities and sizes from wash liquid within the dishwasher.

The use of a centrifugal soil separator in conjunction with a motor-driven pump in a dishwasher is known. Such a soil separator is shown in U.S. Pat. No. 4,319,599, Dingler et al., for example. A motor is typically mounted to a combination pump and soil separator assembly, which in turn provides wash liquid to one or more wash arms within the dishwasher cavity. In operation, the motor-driven pump draws wash liquid from the floor of the dishwasher cavity, pumping a majority of the wash liquid through the wash arms into the dishwasher cavity. A soil-laden, centrifugally sampled portion of the wash liquid is diverted to a sealed accumulator chamber for settling of heavy soils. A stand pipe extending from the bottom of the accumulator chamber permits surface liquid within the accumulator to return to pump inlet, thereby providing recirculation of cleansed wash liquid within the dishwasher.

A problem associated with such a design is that pressure within the sealed accumulator chamber limits the rate of wash liquid flow into and through the accumulator chamber. Pressure within the chamber may be expected to be approximately 6 ½ PSI, resulting in a flow rate through the accumulator chamber of approximately ½ gallon per minute. As a result, during a single wash cycle, the total flow of wash liquid through the accumulator chamber is limited, thereby reducing the system's soil removal effectiveness.

Another disadvantage associated with such a design is its relative inability to remove soil particles having a specific gravity less than one from the wash liquid, due to the fact that floating particles within the accumulator chamber are permitted to return to circulation by means of the standpipe. Yet another disadvantage associated with such a design is the requirement of a complex spring-loaded check valve for sealing the accumulator chamber.

In U.S. Pat. No. 4,392,891, Meyers, a dishwasher includes a combination soil collector and motor-driven pump. In a wash cycle, the motor-driven pump directs a majority of wash liquid circulated thereby to one or more wash arms, which in turn distribute wash liquid within the dishwasher wash cavity. The remainder of the wash liquid is diverted to a soil collecting circuit which circulates wash liquid to a soil collector. The soil collector includes a filter for filtering food soil from fluid passing therethrough and holds the soil for discharge into the dishwasher drain system.

A disadvantage associated with such a design is its relative inefficiency compared to a centrifugally sampling soil separator, in that a random sample of the wash liquid necessarily contains a lower concentration of entrained soil compared to a centrifugally sampled portion. Therefore, despite a relatively high flow rate resulting from the fact that the soil collector chamber is open to atmospheric pressure, soil is removed from circulation at less than an ideal rate.

In another aspect of U.S. Pat. No. 4,392,891, Meyers, and also as shown in U.S. Pat. No. 4,673,441, Meyers, the wash arms include downwardly directed orifices for directing a spray jet on the upper surface of the soil collector filter as the wash arms rotate. The spray jet provides a backflushing action, which prevents clogging of the filter by food soil retained within the soil collector. A disadvantage to the downwardly directed orifices as disclosed is their relative inefficiency in properly backflushing the soil collector filter.

In U.S Pat. No. 3,575,185, Barbulesco, a dishwasher includes a spray bar having a strainer for rotation therewith. A plurality of axially directed ports within the bottom portion of the spray bar bypass wash fluid onto a stationary flat disc-shaped deflector plate. The deflector plate has axially upturned outer and inner edges, thereby defining a horizontal fluid-collecting trough. A radially outwardly and downwardly formed outlet ramp in the deflector plate permits fluid to drain from the deflector plate, causing the fluid to impact the strainer for backflushing a limited arcuate extent of the strainer. A disadvantage to the design includes the relatively low pressure of the gravity-fed water to the strainer, thereby providing a relatively ineffective backflushing action. A further disadvantage to the disclosed design is its ability to backflush only a limited arcuate extent of the strainer. Yet another disadvantage to the disclosed design is its inability to provide a direct fan-shaped backflushing spray normal to the direction of travel of the strainer.

SUMMARY OF THE INVENTION

In accordance with the present invention, the disadvantages of the prior art dishwasher soil separators have been overcome. A dishwasher soil separator constructed in accordance with the present invention includes a combination motor-pump and soil separator assembly having a lower wash arm assembly disposed thereon. The motor-pump assembly includes a wash impeller, which operates within a pump cavity located within the soil separator. The pump cavity is defined by an annular interior wall in combination with a lower housing wall. As the impeller operates in a wash or rinse mode, a swirling motion is created in the wash liquid passing through the pump cavity, thereby creating a centrifugally sampled annular layer of wash liquid on the annular interior wall. This portion of the wash liquid, having a high concentration of entrained soil, passes over an upper edge of the annular interior wall and into an annular guide chamber.

The wash liquid then travels from the annular guide chamber to an annular soil container chamber, at a high flow rate heretofore unknown in a centrifugal-type soil separator. This high flow rate is achieved by use of a relatively small aperture located in a lower portion of the annular wall separating the guide chamber and the soil container chamber, with the soil container chamber being open to atmospheric pressure. Use of a relatively small aperture also minimizes pressure loss within the pump cavity, which in turn maximizes pressure to the wash arm assembly. The high flow rate of soil-laden wash liquid into the soil collection chamber also accomplishes the desirable result of maximizing flow through the soil collector chamber, which increases the likelihood an individual soil particle will be rapidly removed from circulation within the dishwasher.

Upon entering the soil collection chamber, wash liquid flows outwardly and upwardly therein, and is prevented from draining out of a soil container drain port by a ball check valve seated within the drain port. Wash liquid is permitted to flow freely upwardly, due to the low effective pressure within the soil container chamber. When the level of wash liquid reaches the top of the soil container chamber, cleansed wash liquid is permitted to flow out of the soil container chamber through the soil separator cover. The soil separator cover contains an annular arrangement of fine mesh filters, which prevent soil particles entrained in the wash liquid from reentering the dishwasher space. Cleansed wash liquid emitted from the soil container chamber in this fashion drains to the dishwasher floor, where it is picked up by the motor-driven pump for recirculation within the dishwasher.

Further in accordance with the present invention, the wash arm assembly includes a disc-shaped filter guard or screen cover for protecting the fine mesh filters from damage caused by falling objects such as tableware. A downwardly directed nozzle in each of the lower wash arms directs a spray of wash liquid downwardly from the wash arm assembly. The spray impinges a deflector tab mounted on the filter guard, providing a downwardly directed fan-shaped spray of wash liquid. As the wash arm assembly rotates, each of the nozzles describes an arcuate path corresponding to the annular arrangement of fine mesh filters located in the soil separator cover. A backflushing action within the fine mesh filters is created, preventing the filters from becoming clogged by accumulated soil particles.

An object of the invention is to provide a soil removal system in a dishwasher that rapidly removes entrained soil particles from the wash liquid.

Another object of the invention is to provide a soil removal system that rapidly removes both heavy and light entrained soil particles from the wash liquid.

Yet another object of the invention is to provide a soil removal system that rapidly removes both heavy and light entrained soil particles of varying sizes from the wash liquid, while minimizing pressure loss to the wash arm assembly resulting from the soil removal process.

Yet a further object of the invention is to provide a soil removal system that is both economical to manufacture and reliable in use.

BRIEF DESCRIPTION OF THE DRAWINGS

FIG. 1 is a perspective view of a dishwasher including a soil separator in accordance with the present invention;

FIG. 2 is a plan view of the soil separator having the wash arm assembly removed therefrom and with a portion of the soil separator screen cut away;

FIG. 4 is an elevational view of a portion of an interior wall of the soil separator of FIG. 2 shown along line IV—IV;

DESCRIPTION OF THE PREFERRED EMBODIMENTS

Figure 3:
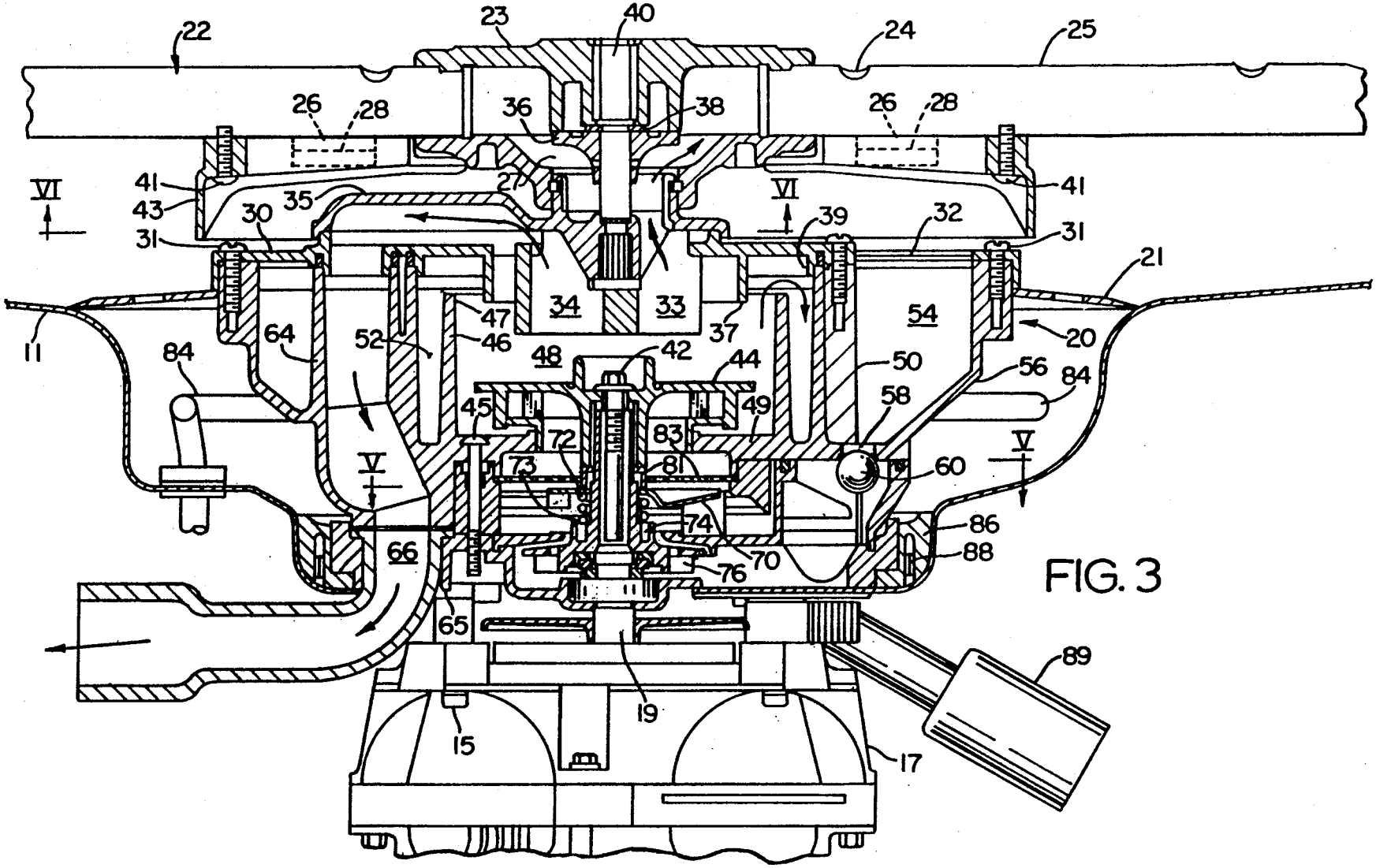
FIG. 3 is a diametric section of the soil separator including the wash arm assembly, taken along line III—III of FIG. 2.

In accordance with the invention as shown in the drawings, and particularly as shown in FIG. 1, an automatic dishwasher generally designated 10 includes an interior tank wall 12 defining a dishwashing space 14. A soil separator 20 is centrally located in floor 11 and has a lower wash arm assembly 22 extending from an upper portion thereof. Coarse particle grate 21 permits wash liquid to flow from floor 11 to soil separator 20, while preventing foreign objects, such as apricot pits and poptops, from inadvertently entering soil separator 20.

Referring now to FIG. 3, the soil separator and pump assembly generally comprises a motor 17 having an output shaft 19 secured to base plate 65 by bolts 15. The motor 17 is a reversing motor which normally operates in a clockwise direction, as viewed in FIG. 2. When operated in a clockwise direction, such as in a wash mode or a rinse mode, the motor 17 provides a pumping action within soil separator 20, thereby providing pressurized wash liquid to lower wash ar assembly 22.

Lower wash arm assembly 22 includes a central hub 23 having a plurality of wash arms 25 extending radially therefrom. Each wash arm 25 includes one or more upwardly directed spray nozzles 24 for directing wash liquid upwardly within dishwashing space 14, and one downwardly directed spray nozzle 26 for providing a back-washing action, as will become apparent. Each downwardly directed spray nozzle 26 has a deflector tab 28 disposed immediately adjacent thereto, for providing a dispersed fan-shaped spray, as will be fully discussed hereinafter. Liquid passageway 27 in central hub 23 permits pressurized wash liquid to flow to the lower wash arm assembly 22.

As shown in FIG. 2, the soil separator 20 further includes an annular cover 30 which is disposed over and secured to soil container wall 56 by screws 31. When in place, cover 30 and soil container wall 56 combine to form a low-pressure water seal, preventing leakage of water therebetween. Cover 30 includes a series of fine mesh filter segments 32 which are radially disposed about a central axis of the cover. Fine mesh filter segments 3 are preferably formed of a synthetic material such as nylon or polyester and have a mesh on the order of 0.0049" to 0.0106".

Located radially inwardly from the fine mesh filter segments 32 and depending downwardly from cover 30 is an annular lip 39. Annular lip 39 forms a high-pressure seal in combination with upstanding wall 50, as will become apparent. An upper wash arm feed channel 35 is disposed on top of cover 30, providing a continuous flow path for transporting pressurized wash liquid from the impeller 44, through upper wash arm feed tube 64, downwardly to conduit 66 and to the upper wash arm (not shown).

Further located radially inwardly from the annular lip 39 of cover 30 is a downwardly depending annular wall 37. Annular wall 37 defines a centrally located interior area containing a plurality of vanes for directing pressurized wash liquid. Lower wash arm feed vanes 33 direct a first portion of the pressurized wash liquid through liquid passageway 27 to wash arms 25. Corresponding upper wash arm feed vanes 34 direct a second portion of the pressurized wash liquid to upper wash arm feed channel 35. Extending upwardly at the central axis of the cover is a fixed spindle 40.

Bushing 36 is mounted on spindle 40 by any appropriate conventional means, such as a drift pin. Washer 38 is supported by bushing 36, providing a low-friction support for lower wash arm assembly 22.

Figure 6:
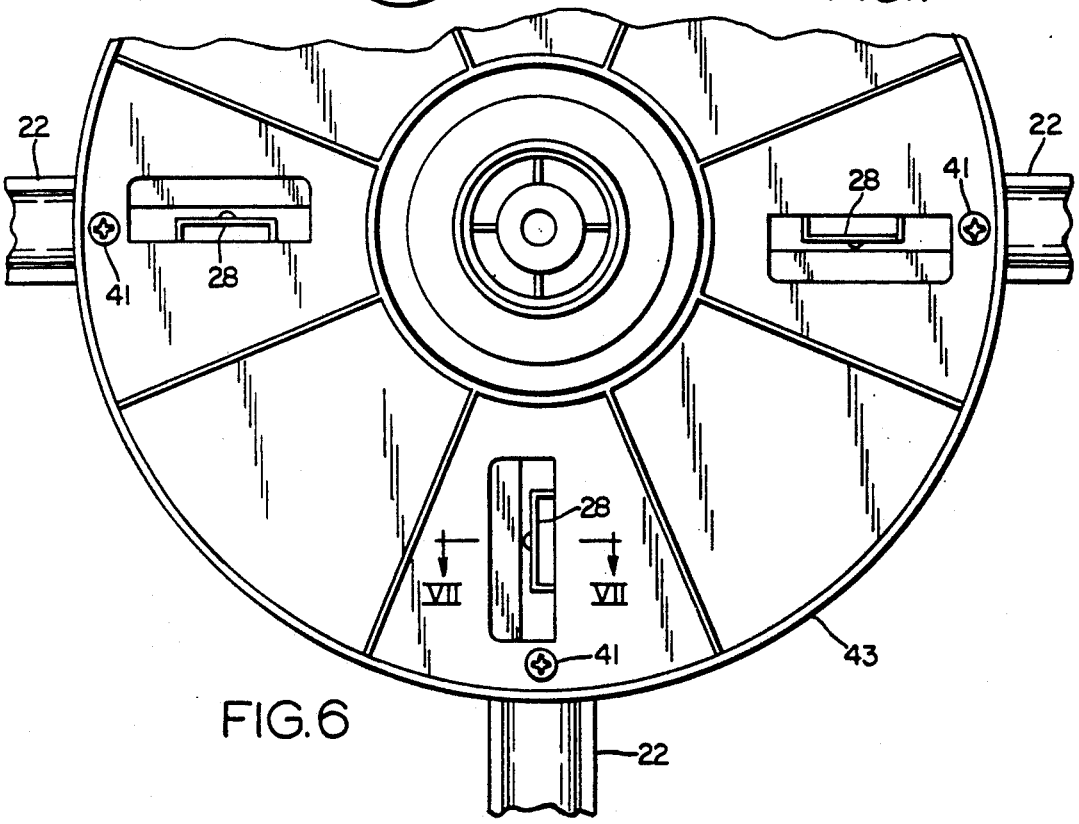
FIG. 6 is a partially cut away bottom view of the wash arm assembly and screen cover shown in FIG. 3 along line VI—VI.

Referring now to FIG. 3, it may be seen that lower wash arm assembly 22 is freely rotatably mounted about its central axis on spindle 40. As shown in FIGS. 3 and 6, filter guard 43 is mounted to wash arms 25 by screws 41. Filter guard 43 overlies the fine mesh filter segments 32 of cover 30, protecting fine mesh filter segments 32 from damage caused by falling utensils or tableware. In operation, pressurized wash liquid flows past bushing 36 into wash arms 25. Upwardly directed nozzles 24 are positioned on wash arms 25 so as to provide a chordally directed thrust, causing lower wash arm assembly 22 to rotate about spindle 40 when pressurized wash liquid is pumped through nozzles 24.

Figure 7:
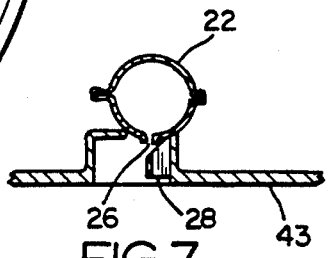
FIG. 7 is an enlarged section of the wash arm and the screen cover shown in FIG. 6 along line VII—VII.

As lower wash arm assembly 22 rotates, pressurized wash liquid is emitted from downwardly directed nozzles 26. As shown in FIGS. 6 and 7, deflector tabs 28 each have a planar, water deflecting surface disposed at an angle to the corresponding downwardly directed nozzle 26. The deflector tabs 28 are integrally formed as part of filter guard 43 and are disposed directly beneath each nozzle 26, impinging on the flow of wash liquid emitted therefrom. As the flow of water from each nozzle 26 strikes the associated deflector tab 28, a fan-shaped spray is formed (not shown). Each fan-shaped spray describes an arcuate path that sweeps substantially the entire width of the top of the fine mesh filter segments 32 as lower wash arm assembly 22 rotates. The fan-shaped sprays therefore directly impact the fine mesh filter segments 32, providing a continuous high-pressure backwashing action to keep fine mesh filter segments 32 clear of soil particles which may impede the flow of cleansed wash liquid into dishwashing space 14.

Soil separator 20 also includes a wash impeller 44, located within pump cavity 48. Pump cavity 48 is generally defined by the soil separator lower housing wall 49, a first upstanding annular wall 46, and cover 30. Screws 45 passing through lower housing wall 49 within pump cavity 48 secure soil separator 20 to base plate 65.

Wash impeller 44 is secured to the output shaft 19 of pump motor 17 by impeller retaining bolt 42, and pumps wash liquid at the rate of approximately 40 gallons per minute when in operation. The majority of the pressurized wash liquid enters the area beneath the cover 30 defined by downwardly depending annular wall 37, and is divided and directed by lower wash arm feed vanes 33 and upper wash arm feed vanes 34. Under normal operating conditions, flow of pressurized wash liquid is provided to the lower wash arm at the approximate rate of 28 gallons per minute, and to the upper wash arm at the approximate rate of 8 gallons per minute.

During normal operation, a third portion of the wash liquid is maintained within the soil separator to be cleansed and returned to circulation. In pump cavity 48, a portion of the wash liquid having a high concentration of entrained soil tends to accumulate on a first upstanding annular wall 46. The swirling motion of the liquid tends to carry the soil upwardly over the upper edge 47 of wall 46, whereupon the soil-laden liquid collects within annular guide chamber 52 defined between first upstanding annular wall 46 and second upstanding annular wall 50. Undesirable pressure loss within the annular guide chamber 52 is prevented by forming a relatively water-tight, high pressure seal at the juncture of cover 30 and second upstanding annular wall 50.

As shown in FIG. 4, an aperture 51 provides an opening between the second annular guide chamber 52 and a soil container chamber 54, permitting soil entrained wash liquid to flow therethrough. Under normal operating conditions, wash liquid flows through aperture 51 at the rate of approximately 4 gallons per minute. Aperture 51 is advantageously formed in the lower portion of the annular wall 50, permitting substantially complete draining of annular guide chamber 52. In one embodiment, shown in FIG. 4, aperture 51 has a trapezoidal-shaped horizontal cross-section which expands outwardly from annular guide chamber 52 to soil container chamber 54.

Soil container chamber 54 is generally defined by lower housing wall 49, soil container wall 56, second upstanding annular wall 50 and cover 30. As soil-entrained wash liquid flows from annular guide chamber 52, the liquid level in soil container chamber 54 rises until reaching cover 30. A portion of the soil entrained in the wash liquid settles within soil container chamber 54, particularly those heavier soil particles having a specific gravity greater than one. Lighter soils, however tend to rise within soil container chamber 54, until reaching cover 30.

Fine mesh filter segments 32 in cover 30 permit flow of cleansed wash liquid to return to dishwasher space 14 for recirculation. Light soil particles are screened by fine mesh filter segments 32 and retained in soil container chamber 54. Accordingly, both heavy and light soil particles remain within the soil container chamber while maintaining a relatively high rate of flow through the soil container chamber.

When operated in a wash or rinse mode, the dishwasher functions as a continuous fluid circuit. In a wash mode, for example, wash liquid flows from dishwashing space 14 to dishwasher floor 11 and is gravity-fed to coarse particle grate 21. Wash liquid flows past heating unit 84 to soil separator 20, where it is drawn inwardly by negative pressure created by impeller 44. Wash liquid flows over sealing ring 86, which, in combination with floor 11 and retainer ring 88, serve to support and seal the soil separator and pump assembly within the dishwasher. Wash liquid continues to flow horizontally and inwardly over base plate 65, until encountering soft soil chopper 70.

Figure 5:
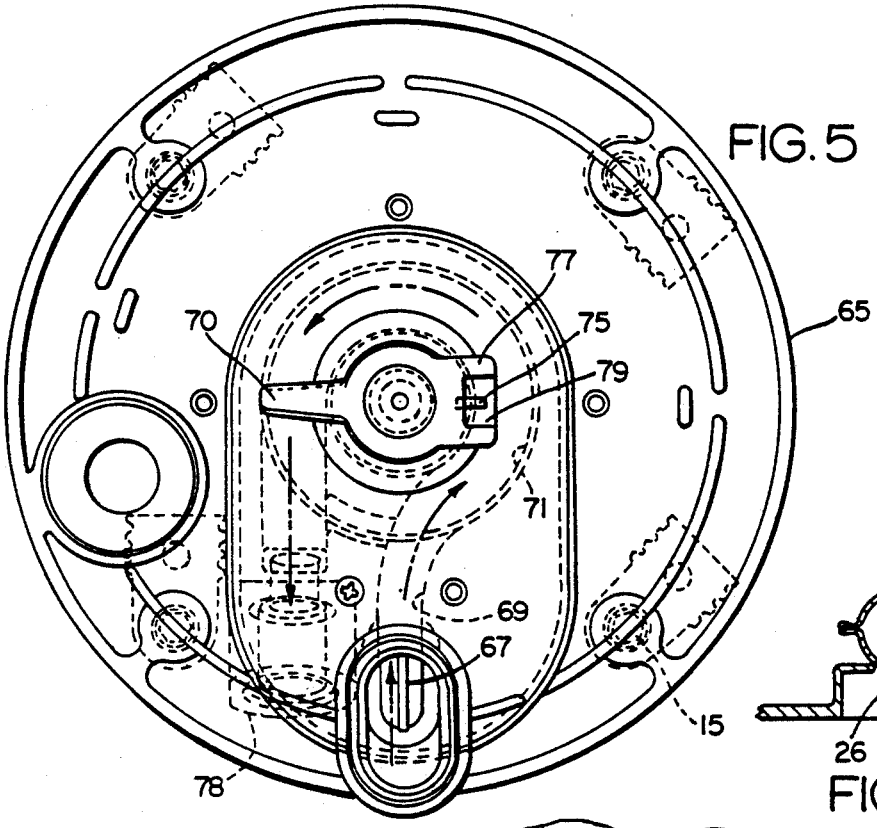
FIG. 5 is an enlarged transverse section taken substantially along line V—V of FIG. 3.

As may best be observed in FIGS. 3 and 5, soft soil chopper 70 is located on motor shaft 19 and rotates therewith to macerate large soft soil particles which travel past grate 21. Torsion spring 72 both supports and drives chopper 70, urging chopper 70 upwardly against collar 81, which in turn is held in place on output shaft 19 by a downwardly depending shoulder of wash impeller 44. An axially extending lower end 73 of torsion spring 72 extends into a blind hole 74 in an upper shoulder of drain impeller 76. A radially extending upper portion 75 of torsion spring 72 extends into v-shaped groove 79 of radial tongue 77.

After passing soft soil chopper 70, wash liquid is drawn through grate 83 and further upwardly into pump cavity 48 by wash impeller 44. Wash impeller 44 imparts a swirling motion to the wash liquid, forcing a majority of the wash liquid upwardly to lower wash arm feed vanes 33 and upper wash arm feed vanes 34. Wash liquid sprayed from upwardly directed spray nozzles 24, downwardly directed spray nozzles 26 and cleansed wash liquid emitted from fine mesh filter segments 32 into dishwashing space 14 returns to floor 11 to be recycled.

Due to the centrifugal force acting on the swirling liquid in pump cavity 48, the remainder of the wash liquid forms a band or layer on the interior of first upstanding annular wall 46. This band of wash liquid contains a heavy concentration of entrained soil particles having a relatively high specific gravity, which tend to be forced outwardly by centrifugal force. This band of wash liquid also contains approximately the same concentration of soil particles having a relatively low specific gravity representative as the wash liquid as a whole.

As the wash liquid swirls upwardly in a clockwise direction, the concentrated soil particles accumulated on the interior of first upstanding annular wall 46 flow over the upper edge 47 with a portion of the wash liquid. Wash liquid accumulates in annular guide chamber 52, to be forced through aperture 51 in second upstanding annular wall 50, as may best be seen in FIG. 4. Due to the relatively small size of aperture 51, low pressure loss in annular guide chamber 52 and pump cavity 48 is achieved. At the same time, due to the high pressure drop from annular guide chamber 52 to soil container chamber 54, a high flow rate through aperture 51 is achieved.

As soil-laden wash liquid flows into soil container chamber 54, its velocity is reduced, permitting heavy soil particles to collect on lower housing wall 59. As the clockwise rotation of wash impeller 44 forces soil-laden wash liquid into soil container chamber 54, clockwise rotation of drain impeller 76, as shown in FIG. 5, causes a clockwise flow of wash liquid within drain pump chamber 71.

Pressure created by wash liquid flow within drain pump chamber 71 causes ball check valve 60 to rise from a resting position on ball check valve support 67 to a seated position on the bottom side of soil container drain port 58, as shown in FIG. 3. When so positioned, ball check valve 60 prevents flow of accumulated soil particles and wash liquid therethrough. Check valve 89 located in line with and downstream of drain port 78 prevents air from entering drain port 78 during operation of drain impeller 76 in a clockwise direction.

Since the soil collection chamber 54 is exposed to atmospheric pressure, cleansed wash liquid quickly flows through fine mesh filter segments 32 and is returned to circulation within dishwasher space 14, to be continuously recirculated along with wash liquid emitted from upwardly directed nozzles 24 and downwardly directed nozzles 26. Accordingly, fine mesh filter segments 32, in combination with downwardly directed nozzles 26 and upwardly directed nozzles 24, achieve a high flow rate of wash liquid through soil separator 20. The high flow rate through soil separator 20 increases its effectiveness, since during a single wash cycle, the wash liquid passes through soil separator 20 a higher number of times, increasing the likelihood a particular soil particle will be removed from circulation.

Upon completion of a wash or a rinse cycle, a drain cycle is initiated. At that time, pump motor 17 is reversed, causing drain impeller 76 to rotate in a counterclockwise direction, as viewed in FIG. 5. Drain impeller 76 causes negative pressure to be applied within conduit 69, which causes ball check valve 60 to fall away from soil container drain port 58. Soil-laden water and accumulated soil within soil container chamber 54 is rapidly pumped out by drain impeller 76, and expelled through drain port 78. In addition, drain impeller 76 is further in fluid connection with floor 11. Wash or rinse liquid draining from soil separator 20 accumulates on base plate 65, and is pumped out through drain port 78 along with liquid from floor 11. Accordingly, when operated in a counterclockwise direction, drain impeller 76 rapidly and effectively drains soil separator 20.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A dishwasher wash arm assembly for distributing wash liquid within a dishwasher, said dishwasher wash arm comprising:

a hub, said hub defining a fluid passageway and having bearing means for rotatably mounting said hub within said dishwasher;

said hub having an upwardly facing side and a downwardly facing side, and including means for mounting a plurality of wash arms thereto;

a plurality of wash arms each having an upwardly facing side and a downwardly facing side;

each of said wash arms having an open end receivable within said hub and in fluid connection with said hub fluid passageway, each of said wash arms further having a plurality of apertures permitting flow of wash liquid therethrough, and at least two of which apertures are disposed on opposite sides of said wash arm, each of said wash arms being alignable within said hub such that said two oppositely disposed apertures provide a first upwardly directed stream of wash liquid and a second downwardly directed stream of wash liquid;

a disc-shaped cover removably secured to and underlying said hub, said cover including at least one elongate opening corresponding to each of said wash arms, said elongate opening being aligned with said second downwardly directed stream for permitting flow of said stream therethrough;

said elongate opening having disposed therein spray deflector means for diffusing said downwardly directed stream of wash liquid into a fan-shaped spray.

2. The wash arm assembly of claim 1 wherein said plurality of wash arms consists of four wash arms.

3. The wash arm assembly of claim 11 wherein said deflector means includes a spray deflector having a planar surface disposed adjacent said at least one elongate opening.

4. The wash arm assembly of claim 3 wherein said planar surface is disposed axially along each of said wash arms.

5. The wash arm assembly of claim 3 wherein said planar surface is disposed at an angle relative to said at least one elongate opening.

6. The wash arm assembly of claim 1 wherein said disk-shaped cover includes said spray deflector means integrally formed therewith.

* * * * *